US006956162B2

(12) United States Patent
Koseki et al.

(10) Patent No.: US 6,956,162 B2
(45) Date of Patent: Oct. 18, 2005

(54) APPARATUS AND METHOD FOR PROVIDING REAL-PLAY SOUNDS OF MUSICAL INSTRUMENTS

(75) Inventors: Shinya Koseki, Fukuroi (JP); Haruki Uehara, Hamamatsu (JP); Shigeru Muramatsu, Shyuchi-gun (JP)

(73) Assignee: Yamaha Corporation, Shizuoka-ken (JP)

( * ) Notice: Subject to any disclaimer, the term of this patent is extended or adjusted under 35 U.S.C. 154(b) by 258 days.

(21) Appl. No.: 10/389,436

(22) Filed: Mar. 14, 2003

(65) Prior Publication Data

US 2003/0177889 A1 Sep. 25, 2003

(30) Foreign Application Priority Data

Mar. 19, 2002 (JP) ..... 2002-076888

(51) Int. Cl.[7] ..... G10H 7/00
(52) U.S. Cl. ..... 84/609; 84/645
(58) Field of Search ..... 84/602, 603, 609, 84/645

(56) References Cited

U.S. PATENT DOCUMENTS 5,734,119 A * 3/1998 France et al. ..... 84/622
5,852,251 A * 12/1998 Su et al. ..... 84/645

* cited by examiner

*Primary Examiner*—Jeffrey W Donels
(74) *Attorney, Agent, or Firm*—Harness, Dickey & Pierce, P.L.C.

(57) ABSTRACT

A real-play sound provider is connected with a communication terminal via a network. The user operates the communication terminal to transmit musical tone files, which include tone pitches and tone-generation timings of designated musical tones, to the real-play sound provider, so that the real-play sound provider controls a prescribed musical instrument to play automatic performance based on musical tone files, thus creating real-play sound files. The real-play sound files are created in accordance with prescribed conditions suiting user's preferences and are stored in a storage device of the real-play sound provider. Then, the real-play sound files are transmitted to the communication terminal upon user's designation of an address (e.g., URL) as necessary. Thus, the communication terminal controls a sound reproduction unit to reproduce sounds of the prescribed musical instrument, which is not possessed and played by the user.

22 Claims, 10 Drawing Sheets

APPARATUS AND METHOD FOR PROVIDING REAL-PLAY SOUNDS OF MUSICAL INSTRUMENTS

BACKGROUND OF THE INVENTION

1. Field of the Invention

This invention relates to apparatuses and methods for providing real-play sounds of musical instruments through communications over networks. In addition, this invention also relates to communication tools, programs, and digital storage media for providing real-play sounds of musical instruments.

2. Description of the Related Art

From ancient times, music has been made using a variety of musical instruments, which were diversified in design and have been recently developed and improved using modern technologies. These musical instruments produce a variety of musical sounds when actually played by players (or users).

In general, players may have a desire to actually play a variety of musical instruments. In order to satisfy such a desire, players should actually purchase desired musical instruments or rent them from owners, which may place a great economic burden on players. In addition, it is almost impossible for general users to play extremely expensive musical instruments or to play rare or premium musical instruments having historical value, which may be important materials in studies of music. In spite of such a great desire for players or users to play musical instruments that they do not own, there may exist limited opportunities to play them in actuality.

SUMMARY OF THE INVENTION

It is an object of the invention to provide an apparatus and a method for providing real-play sounds of musical instruments through communications without actually playing them. In addition, it is another object of the invention to provide a communication tool (or a communication terminal), programs, and digital storage media, which realize real-play sounds of musical instruments being provided for users.

There is arranged a real-play sound provider that is connected with a communication terminal via a network, wherein the user of the communication terminal can remote control the real-play sound provider to obtain prescribed online services regarding distribution of musical information and data suiting user's preferences. That is, the user operates the communication terminal to transmit musical tone files, which include tone pitches and tone-generation timings of designated musical tones, to the real-play sound provider via the network, so that the real-play sound provider controls a prescribed musical instrument to play automatic performance based on musical tone files, thus creating real-play sound files. Real-play sound files are stored in a storage device of the real-play sound provider and are transmitted to the communication terminal on demand. Thus, the communication terminal controls a sound reproduction unit to reproduce sounds of the prescribed musical instrument, which is controlled to play automatic performance based on musical tone files.

In the above, the communication terminal has a display allowing the user to perform user-friendly or interactive communications with the real-play sound provider over the network. That is, the user can arbitrarily select a preferred musical instrument from among plural musical instruments, which are provided in the real-play sound provider for user's selection. Herein, the user can briefly listen to sound of the selected musical instrument based on sample data that are provided from the real-play sound provider. In addition, the user can arbitrarily select a preferred play environment from among plural play environments such as churches and concert halls. Furthermore, the user can arbitrarily select a preferred file format for creation of real-play sound files.

Moreover, the user is notified of an address (e.g., URL) for accessing a prescribed page describing real-play sound files stored in the storage device of the real-play sound provider, so that upon entry of such an address on the communication terminal, the user can easily read real-play sound files from the storage of the real-play sound provider as necessary.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

This invention will be described in further detail by way of examples with reference to the accompanying drawings.

[A] Configuration of Embodiment

Figure 1:
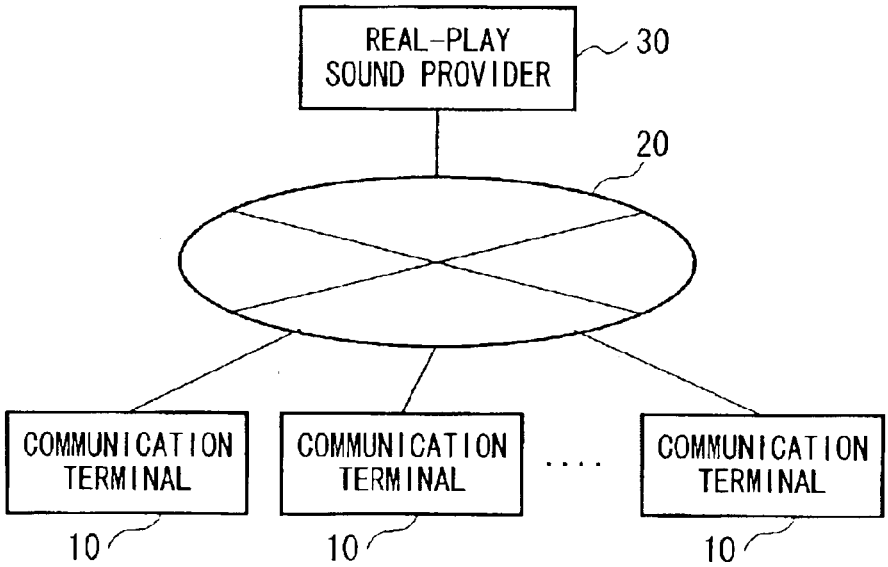
FIG. 1 is a system block diagram showing the overall configuration of a real-play sound providing system in accordance with a preferred embodiment of the invention.

First, a description will be given with respect to the overall configuration of a real-play sound providing system in accordance with the preferred embodiment of the invention with reference to FIG. 1. This system comprises plural communication terminals 10 and a real-play sound provider 30, which are interconnected with a network 20 including the Internet and/or public switched telephone network.

Figure 2:
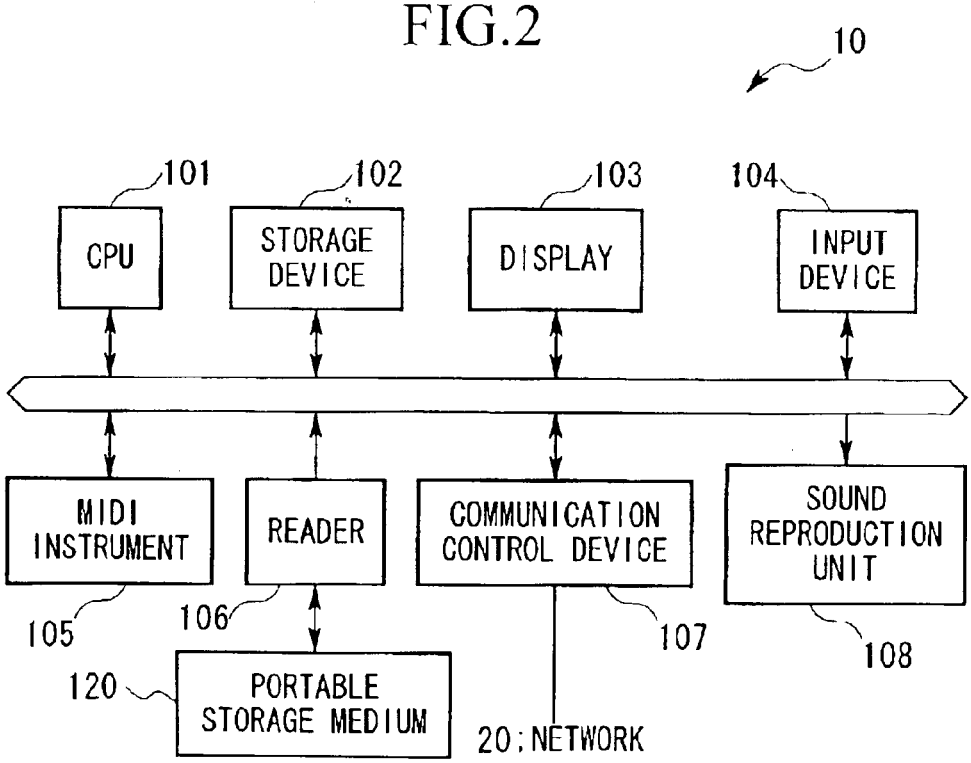
FIG. 2 is a block diagram showing the internal configuration of a communication terminal, which is connected with a real-play sound provider over a network in FIG. 1.

The communication terminals 10 are computer devices such as personal computers, notebook computers, and PDA (personal digital assistant) devices as well as electronic musical instruments and portable telephones (e.g., cellphones, and PHS (personal handyphone system) devices). Each of the communication terminals 10 has an ability to perform communication with the real-play sound provider 30 over the network 20. As shown in FIG. 2, the communication terminal 10 comprises a central processing unit (CPU) 101, a storage device 102, a display 103, an input device 104, a MIDI (i.e., Musical Instrument Digital Interface) instrument 105, a reader 106, a communication control device 107, and a sound reproduction unit 108, all of which are interconnected with a bus 150.

The CPU 101 controls various sections and blocks of the communication terminal 10 by executing programs stored in the storage device 102 and/or a read-only memory (ROM, not shown). The storage device 102 is used to store programs and data for use in execution of the CPU 101, and it is realized by a hard disk drive, for example. The display 103 comprises a cathode-ray tube (CRT) or a liquid crystal display, which displays various images and characters on the screen under the control of the CPU 101. The input device 104 comprises a pointing device such as a mouse and a keyboard allowing the user to enter characters and symbols. Therefore, the input device 104 produces and outputs signals representing user's manipulations to the CPU 101.

The MIDI instrument 105 produces and outputs MIDI data in response to playing operations applied thereto by the user (or player). That is, the MIDI instrument 105 comprises plural manual operators (or manipulators), so that MIDI data are produced when manual operators are each operated by the user. In the present embodiment, the MIDI instrument 105 is constituted as an electronic keyboard instrument comprising a prescribed number of keys, so that MIDI data are produced when keys are each depressed or released by the user. When played by the user, the MIDI instrument 105 sequentially outputs a series of MIDI data, which the CPU 101 converts into musical tone files in a prescribed format of SMF (namely, Standard MIDI File). Musical tone files are stored in the storage device 102. Specifically, musical tone files comprise tone pitches (or note numbers), tone volumes (or velocities), and tone-generation timings with respect to musical tones designated by the user upon playing of the MIDI instrument 105.

The reader 106 reads data stored in a portable storage medium 120 inserted therein. In the present embodiment, the portable storage medium 120 is realized by a magnetic disk (or a magnetic disk type medium), in which musical tone files are stored in the SMF format. That is, the portable storage medium 120 stores musical tone files that are created in other instruments or devices. When the portable storage medium 120 is set (or inserted) into the reader 106, musical tone files stored in the portable storage medium 120 are transferred to the storage device 102. As described above, the present embodiment comprises two series of systems (namely, the MIDI instrument 105 and the reader 106) for providing the storage device 102 with musical tone files.

The communication control device 107 performs communication with the real-play sound provider 30 over the network 20. That is, the communication control device 107 is realized by a modem (i.e., a modulator-demodulator), for example. The communication control device 107 has an ability to transmit data from the CPU 101 to the real-play sound provider 30 over the network 20, and it also has an ability to receive data from the real-play sound provider 30 and to output them to the CPU 101. Specifically, upon reception of musical tone files that are read from the storage device 102 by the CPU 101, the communication control device 107 transmits them to the real-play sound provider 30 over the network 20.

The sound reproduction unit 108 produces sounds and/or musical tones based on digital data supplied thereto from the CPU 101. That is, the sound reproduction unit 108 comprises a digital-to-analog converter (or a D/A converter, not shown) for converting digital data to analog signals, and a speaker (or speakers, not shown) for producing sounds and/or musical tones in response to analog signals. It is possible to replace the speaker with an earphone set or a headphone set, which can be detachably attached to ears of the user.

The real-play sound provider 30 is realized by computer system or computer facilities, which receives musical tone files from the communication terminal 10 over the network 20 and which in turn transmits real-play sound files to the communication terminal 10 over the network 20. Herein, the real-play sound files contain digital data representing real-play sounds, which are produced from a prescribed musical instrument playing automatic performance based on musical tone files transmitted from the communication terminal 10. Incidentally, the communication terminal 10 allows the user to arbitrarily select various conditions such as the type of the musical instrument playing automatic performance based on musical tone files and environmental factors in playing automatic performance. Thus, the user of the communication terminal 10 can easily obtain real-play sound files representing real-play sounds that are produced by a prescribed musical instrument playing automatic performance based on musical tone files, which the user creates by operating the communication terminal 10.

Figure 3:
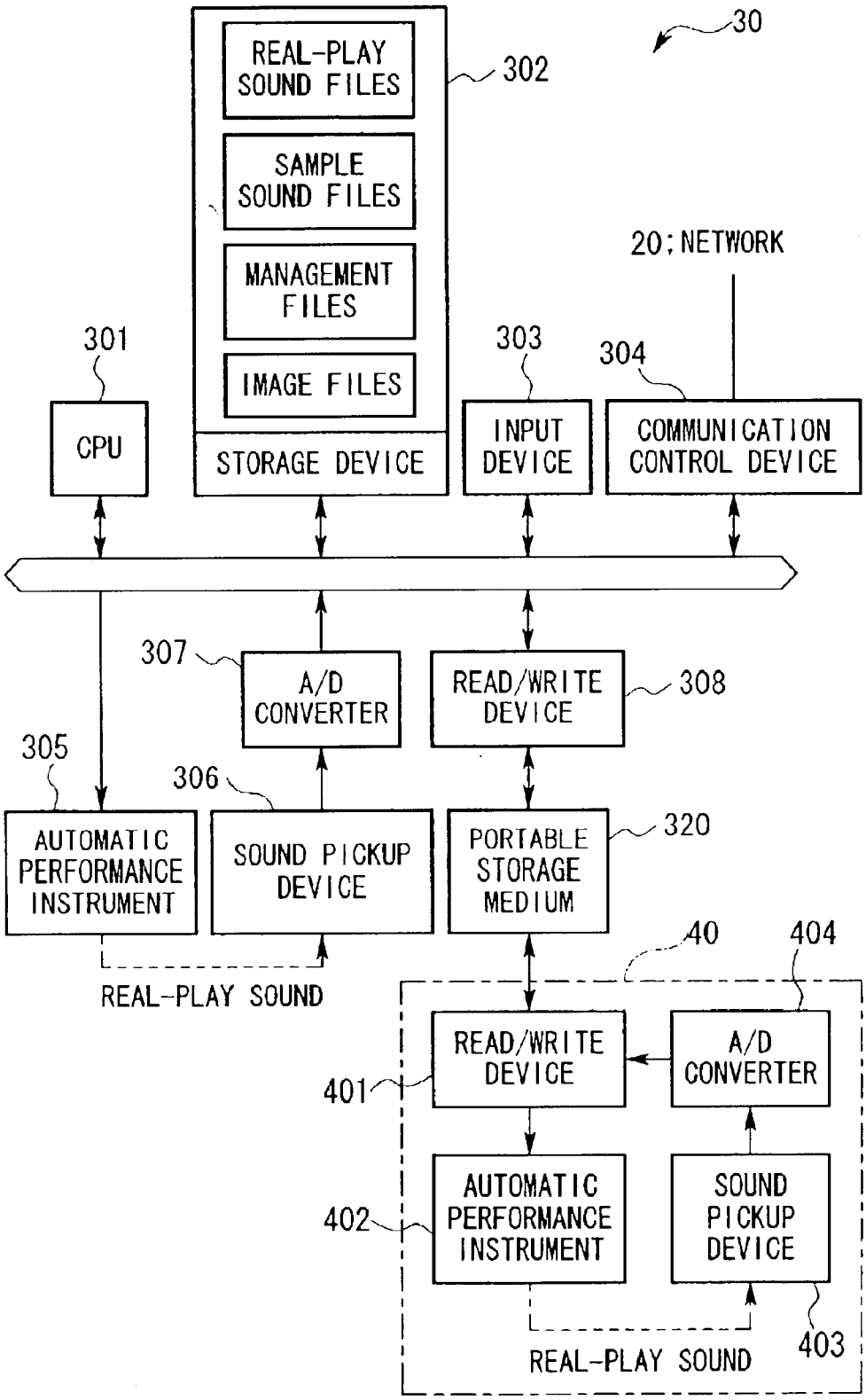
FIG. 3 is a block diagram showing the internal configuration of the real-play sound provider shown in FIG. 1.

As shown in FIG. 3, the real-play sound provider 30 comprises a central processing unit (CPU) 301, a storage device 302, an input device 303, a communication control device 304, an automatic performance instrument 305, a sound pickup device (or an electroacoustic transducer) 306, an analog-to-digital converter (or an A/D converter) 307, and a read/write device 308, which are interconnected together via a bus 350.

In the above, the CPU 301 executes programs stored in the storage device 302, thus acting as a control center for the real-play sound provider 30. The input device 303 outputs signals, corresponding to manager's operations (or administrator's operations) on the real-play sound provider 30, to the CPU 301. The communication control device 304 performs communication with each of the communication terminals 10 over the network 20.

The storage device is realized by a hard disk drive, for example, which stores programs to be executed by the CPU 301 and other information shown in FIG. 3 such as real-play sound files, sample sound files, management files, and image files. Among these files, real-play sound files are created based on musical tone files transmitted from the communication terminal 10. Sample sound files representing real-play sounds of musical instruments are prepared in advance in order to create real-play sound files. That is, sample sound files are constituted by digital data representing real-play sounds that are produced by playing specific musical tunes with various musical instruments, so that these files are stored in advance in the storage device 302 in order to accommodate user's listenings. Management files are prepared in order to manage services that the real-play sound provider 30 provides for users. For example, management files contain identification information (referred to as user IDs) that are directly assigned to users. Image files are constituted by digital data representing various images or pictures to be displayed on the screen of the display 103 of the communication terminal 10. For example, images to be displayed on the screen of the display 103 based on image files may contain prescribed menus allowing the user to arbitrarily select musical instruments, which are used in automatic performance.

The automatic performance instrument 305 is exclusively used for automatic performance to be played based on musical tone files transmitted from the communication terminal 10. That is, it comprises sound sources for producing sounds and an automatic performance structure for driving sound sources based on musical tone files. The present embodiment assumes to use a specific keyboard instrument (e.g., a player piano) having automatic performance functions as the automatic performance instrument 305. Therefore, the automatic performance instrument 305 realizes strings as sound sources and a hammer drive structure for driving hammers to strike strings based on musical tone files. Specifically, the automatic performance instrument 305 drives a hammer designated by a musical tone file at a designated tone-generation timing, thus producing a musical tone when the hammer strikes the string.

The sound pickup device 306 generates electric signals (i.e., analog signals) corresponding to sounds produced by the automatic performance instrument 305. Specifically, it is realized by a microphone. The A/D converter 307 converts analog signals output from the sound pickup device 306 into digital data. The CPU 301 creates real-play sound files based on digital data output from the A/D converter 307, so that the created real-play sound files are stored in the storage device 302.

The read/write device 308 reads data from a portable storage medium 320 or writes data to the portable storage medium 320. The portable storage medium 320 is realized by a portable magnetic disk, for example. That is, the read/write device 308 writes musical tone files transmitted from the communication terminal 10 to the portable storage medium 320.

The real-play sound provider 30 further contains a file creation unit 40, encompassed by dashed lines in FIG. 3, which is used to create real-play sound files in response to musical tone files, similarly to the aforementioned combination of the automatic performance instrument 305, sound pickup device 306, and A/D converter 307. Actually, however, the file creation unit 40 is facilitated at a prescribed place that is terrestrially (or geographically) distanced from the real-play sound provider 30.

That is, the file creation unit 40 comprises a read/write device 401, an automatic performance instrument 402, a sound pickup device 403, and an A/D converter 404. Herein, the read/write device 401 reads musical tone files, which are stored in the portable storage medium 320 by the read/write device 308, and outputs them to the automatic performance instrument 402. Incidentally, the automatic performance instrument 402, sound pickup device 403, and A/D converter 404 operate similarly to the aforementioned automatic performance instrument 305, sound pickup device 306, and A/D converter 307, respectively. Based on musical tone files supplied from the read/write device 401, the automatic performance instrument 402 produces real-play sounds, which are picked up by the sound pickup device 403 and are transduced into electric signals (i.e., analog signals), which are then converted into digital data by the A/D converter 404. That is, the read/write device 401 receives digital data from the A/D converter 404 and stores them in the portable storage medium 320 as real-play sound files. Then, the read/write device 308 reads real-play sound files from the portable storage medium 320 and transfers them to the storage device 302. In summary, the present embodiment provides two series of systems realizing creation of real-play sound files based on musical tone files, namely, a first system comprising the automatic performance instrument 305, sound pickup device 306, and A/D converter 307, and a second system comprising the read/write device 308 and portable storage medium 320 as well as the read/write device 401, automatic performance device 402, sound pickup device 403, and A/D converter 404 (contained in the file creation unit 40).

[B] Operation of Embodiment

Figure 4:
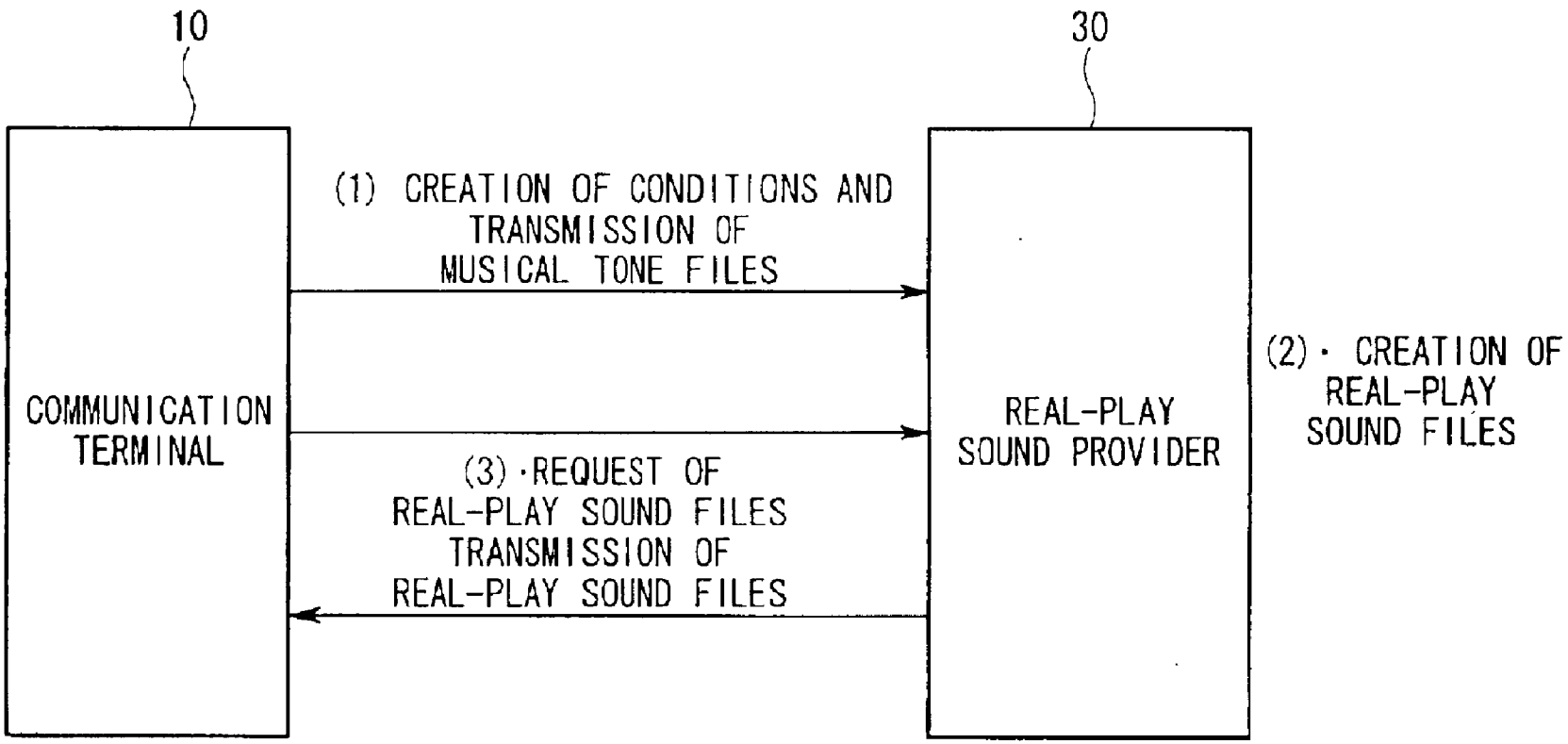
FIG. 4 diagrammatically shows the outline of processing performed between the real-play sound provider and the communication terminal online.

FIG. 4 shows the outline of the overall operation of the present embodiment, which is classified into three operations (1), (2), and (3). In the first operation (1), real-play sound file creating conditions created by the user are transmitted from the communication terminal 10 to the real-play sound provider 30 together with musical tone files, which construct the basis for creation of real-play sound files. Herein, the real-play sound file creating conditions are specific conditions for creating real-play sound files based on musical tone files. For example, they may designate musical instruments (e.g., either the automatic performance instrument 305 or automatic performance instrument 402 shown in FIG. 3) that are used to play automatic performance. In the second operation (2), the real-play sound provider 30 creates real-play sound files based on musical tone files transmitted from the communication terminal 10. After creation of real-play sound files, the control proceeds to the third operation (3) in which the communication terminal 10 sends a request signal requesting transmission of real-play sound files to the real-play sound provider 30, which in turn transmits real-play sound files to the communication terminal 10.

Next, details of the aforementioned operations (1) to (3) will be described below.

Figure 5:
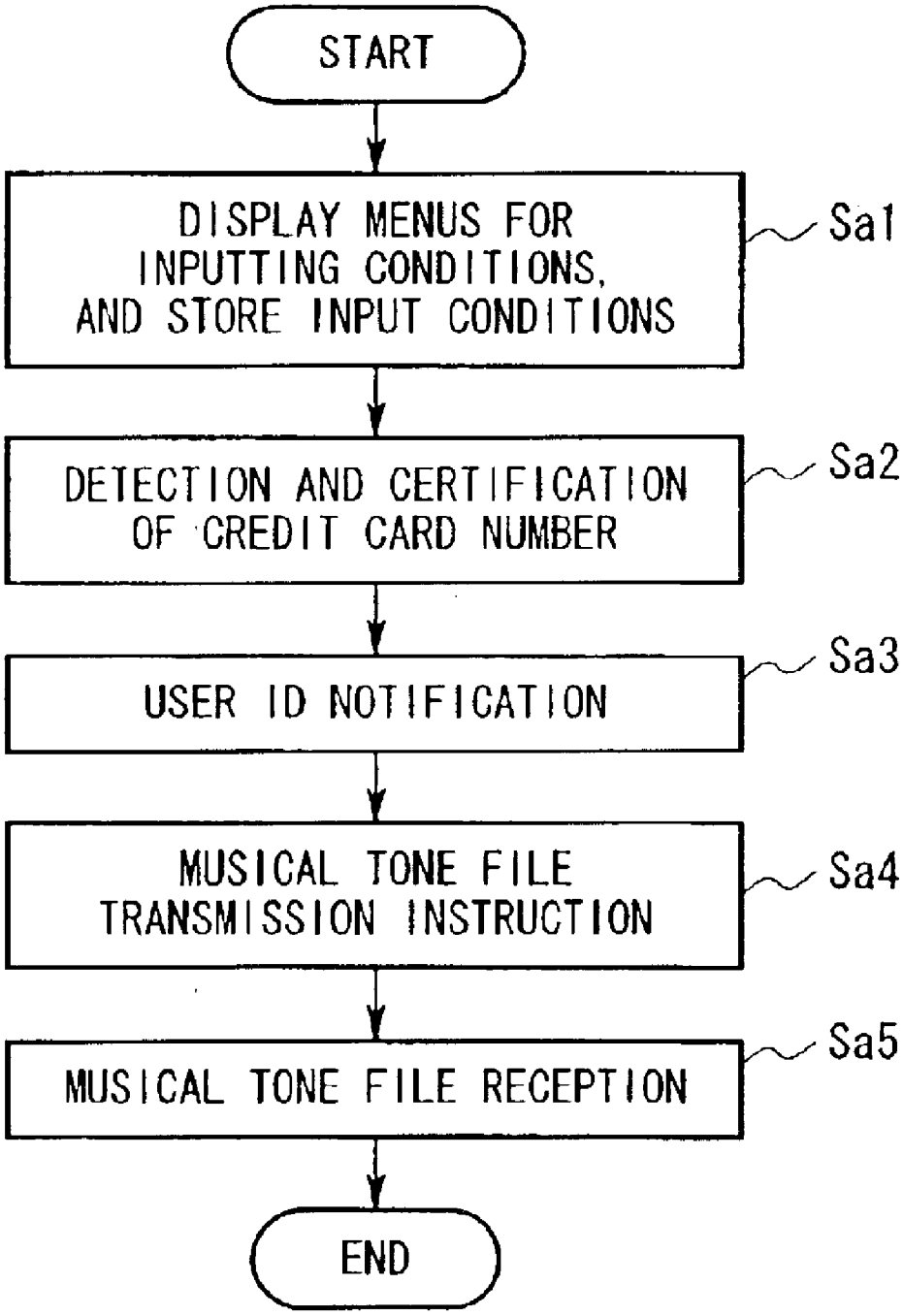
FIG. 5 is a flowchart showing a first process performed by the real-play sound provider realizing the processing shown in FIG. 4.

(1) First Operation for Inputting Real-Play Sound File Creating Conditions and for Transmitting Musical Tone Files First, the user operates the input device 104 to establish connection between the communication terminal 10 and the real-play sound provider 30 via the network 20. Upon detection of connection being established, the CPU 301 of the real-play sound provider 30 executes programs stored in the storage device 302, thus starting a first process, details of which are shown in FIG. 5.

That is, the flow firstly proceeds to step Sa1 in which the CPU 301 of the real-play sound provider 30 accesses the display 103 of the communication terminal 10 to display prescribed menus allowing the user to arbitrarily select real-play sound file creating conditions on the screen on the basis of image files stored in the storage device 302. Upon acknowledgement in which the user operates the communication terminal 10 to input or select desired items, the CPU 301 adds input items to management files stored in the storage device 302. Next, details of menus displayed on the screen of the display 103 and details of items to be input by the user in step Sa1 will be described with reference to FIGS. 7 to 11.

Figure 7:
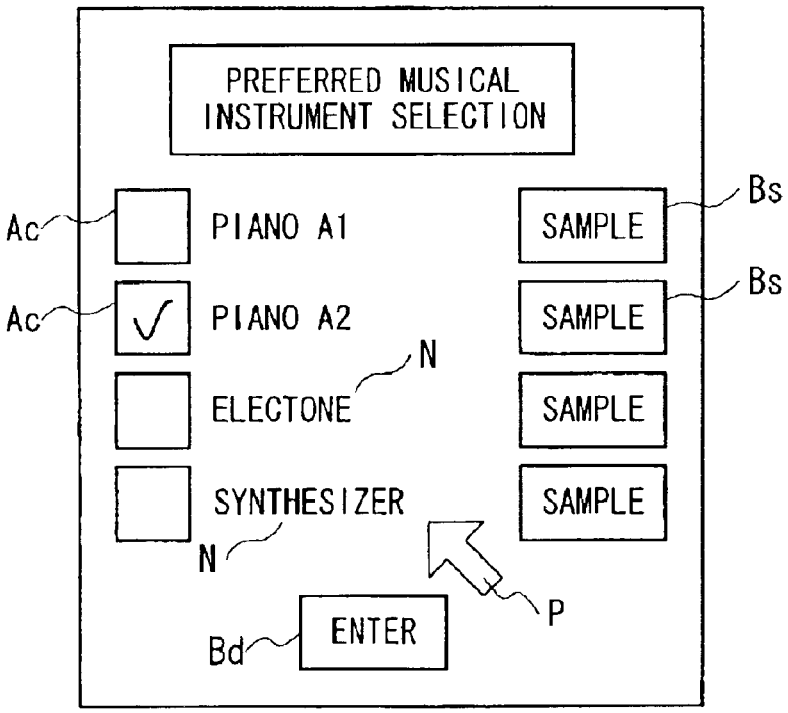
FIG. 7 shows an example of a preferred musical instrument selection menu, which is displayed on the screen of the communication terminal.

First, the CPU 301 of the real-play sound provider 30 controls the communication terminal 10 online to display a preferred musical instrument selection menu, an example of which is shown in FIG. 7, on the screen of the display 103. This menu allows the user of the communication terminal 10 to arbitrarily select a preferred musical instrument (or preferred musical instruments), which is used to produce sounds when creating real-play sound files. Specifically, the preferred musical instrument selection menu of FIG. 7 provides a list of names of musical instruments 'N', which are listed as items for user's selection in playing music and which are accompanied with check regions (or check boxes) 'Ac' on the left therefor. That is, this menu shows four items for user's selection, namely, "PIANO A1", "PIANO A2", "ELECTONE" (i.e., a registered trademark for an electronic organ), and "SYNTHESIZER". That is, the user operates a mouse (i.e., input device 104) to move a pointer (or a cursor) P to match a check region Ac corresponding to a preferred musical instrument; then, the user clicks the mouse button to select the preferred musical instrument. Therefore, a check mark is automatically displayed in the check region Ac corresponding to the preferred musical instrument when selected. FIG. 7 shows an example of the preferred musical instrument selection menu in which "PIANO A2" is selected (or checked) by the user.

On the right side of the preferred musical instrument list 'N', "SAMPLE" buttons Bs are displayed in the preferred musical instrument selection menu. By clicking a mouse button on a desired SAMPLE button Bs, the user can give a brief audition to real-play sound of the selected musical instrument. That is, upon detection of clicking of a mouse button on any one of SAMPLE buttons Bs corresponding to musical instruments, the CPU 301 of the real-play sound provider 30 reads sample sound files corresponding to the selected musical instrument from the storage device 302 and transmits them to the communication terminal 10 via the network 20. Then, the sound reproduction unit 108 of the communication terminal 10 produces a sample of real-play sound of a specific musical instrument, which is selected by clicking a mouse button on the SAMPLE button Bs in the preferred musical instrument selection menu. Therefore, the user can determine whether to select the musical instrument upon brief listening (or audition) to the real-play sound thereof.

After completion of selecting the preferred musical instrument, the user clicks an "ENTER" key (or "OK" key) Bd with a mouse on the preferred musical instrument selection menu. This makes the CPU 301 of the real-play sound provider 30 to recognize the selected musical instrument, information of which is then added to management files in the storage device 302. Similar to the preferred musical instrument selection menu, an ENTER key Bd is contained in each of other menu images, details of which will be described below, so that upon detection of clicks of ENTER keys Bd, selected items are recognized by the CPU 301 of the real-play sound provider 30 and are added to management files stored in the storage device 302.

Figure 8:
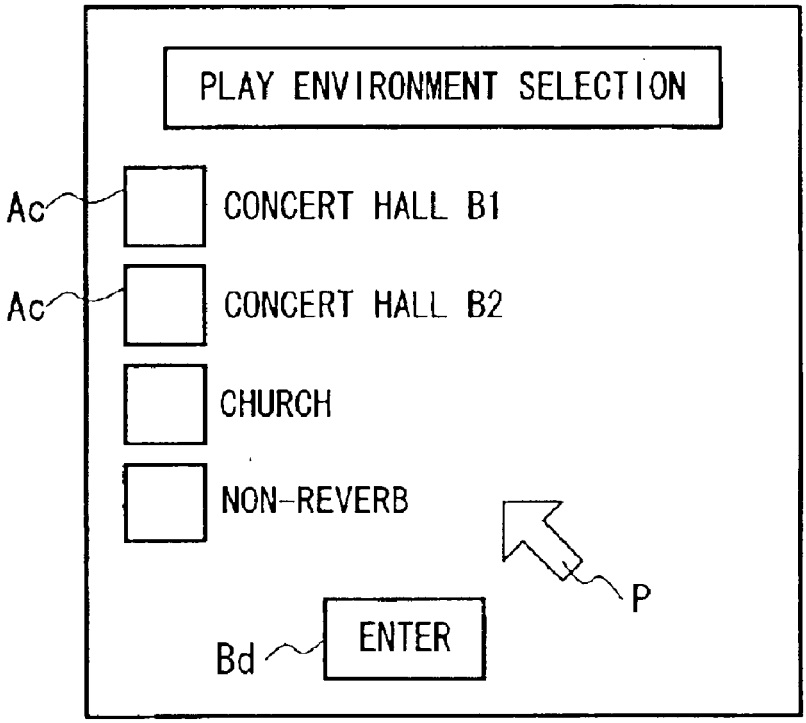
FIG. 8 shows an example of a play environment selection menu, which is displayed on the screen of the communication terminal.

The CPU 301 of the real-play sound provider 30 controls the communication terminal 10 online to display a play environment selection menu, an example of which is shown in FIG. 8, on the screen of the display 103. This menu allows the user of the communication terminal 10 to arbitrarily select a desired environment in producing real-play sound of the selected musical instrument. Specifically, this menu shows three items, namely, "CONCERT HALL B1", "CONCERT HALL B2", "CHURCH", and "NON-REVERB", any one of which can be arbitrarily selected by the user as the play environment.

Figure 9:
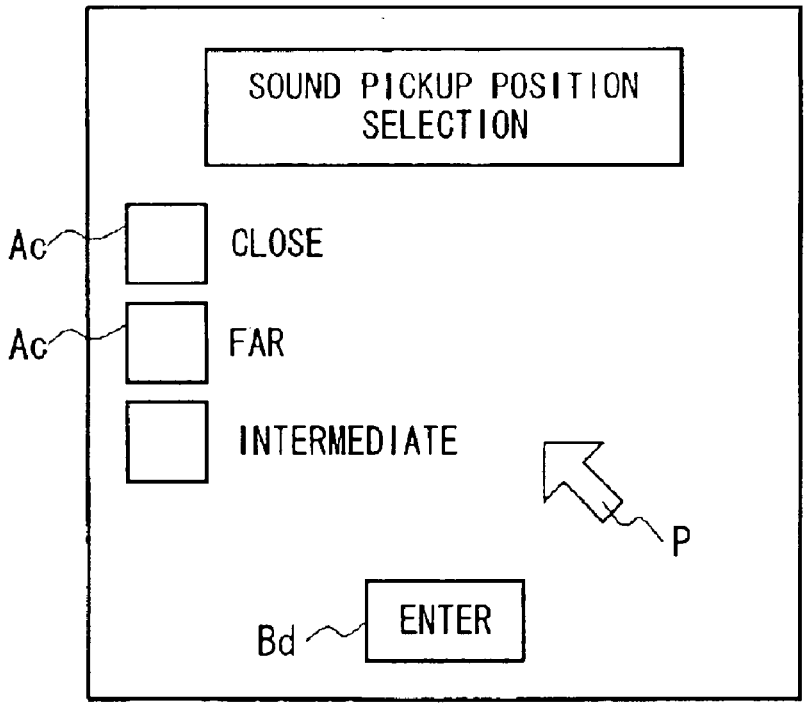
FIG. 9 shows an example of a sound pickup position selection menu, which is displayed on the screen of the communication terminal.

Upon selection of a desired play environment in the play environment selection menu of FIG. 8, the CPU 301 of the real-play sound provider 30 controls the communication terminal 10 online to display a sound pickup position selection menu, an example of which is shown in FIG. 9, on the screen of the display 103. This menu allows the user to arbitrarily select a position of the sound pickup device 306 or the sound pickup device 406 arranged relative to the musical instrument. That is, this menu shows three items, namely, "CLOSE", "FAR", and "INTERMEDIATE", any one of which can be arbitrarily selected by the user as the sound pickup position.

Upon selection of a desired sound pickup position in the sound pickup position selection menu of FIG. 9, the CPU 301 of the real-play sound provider 30 controls the communication terminal 10 online to display an output file format selection menu on the screen of the display 103. This menu allows the user to arbitrarily select a desired file format for outputting real-play sound files. That is, this menu shows four items, namely, "WAVE", "AIFF" (i.e., Audio Interchange File Format), "MP3" (i.e., MPEG Audio Layer-3), and "WMA" (i.e., Windows Media Audio), any one of which can be arbitrarily selected by the user.

Figure 10:
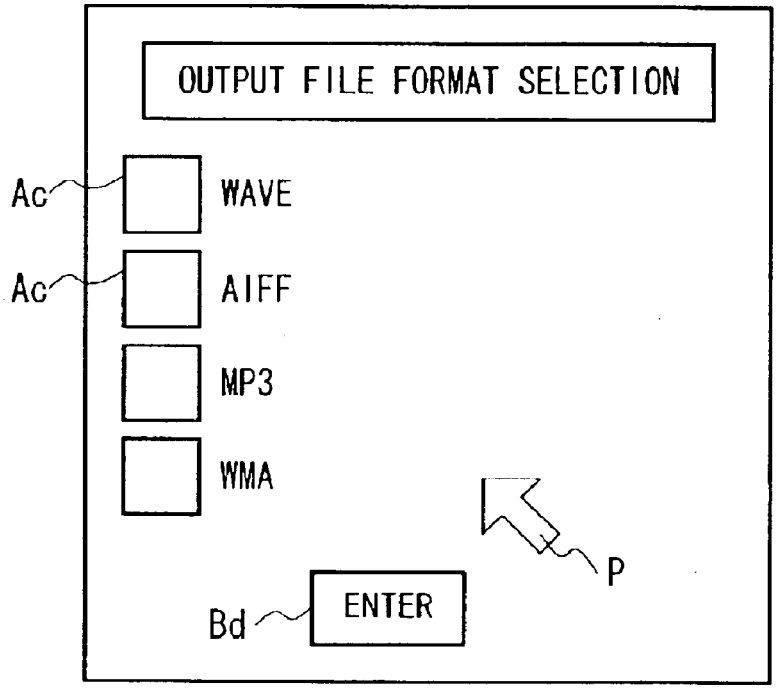
FIG. 10 shows an example of an output file format selection menu, which is displayed on the screen of the communication terminal.
Figure 11:
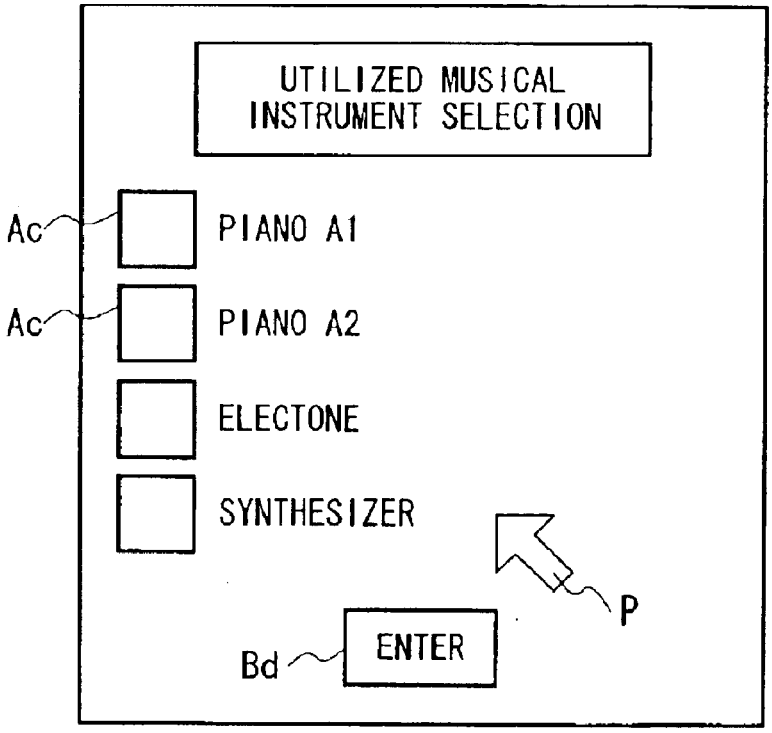
FIG. 11 shows an example of a utilized musical instrument selection menu, which is displayed on the screen of the communication terminal.

Upon selection of a desired output file format in the output file format selection menu of FIG. 10, the CPU 301 of the real-play sound provider 30 controls the communication terminal 10 online to display a utilized musical instrument selection menu, an example of which is shown in FIG. 11, on the screen of the display 103. This menu allows the user to arbitrarily select a utilized musical instrument (or utilized musical instruments), which is used when creating musical tone files. That is, this menu shows four items, namely, "PIANO A1", "PIANO A2", "ELECTONE", and "SYNTHESIZER", any one of which can be arbitrarily selected by the user.

Figure 12:
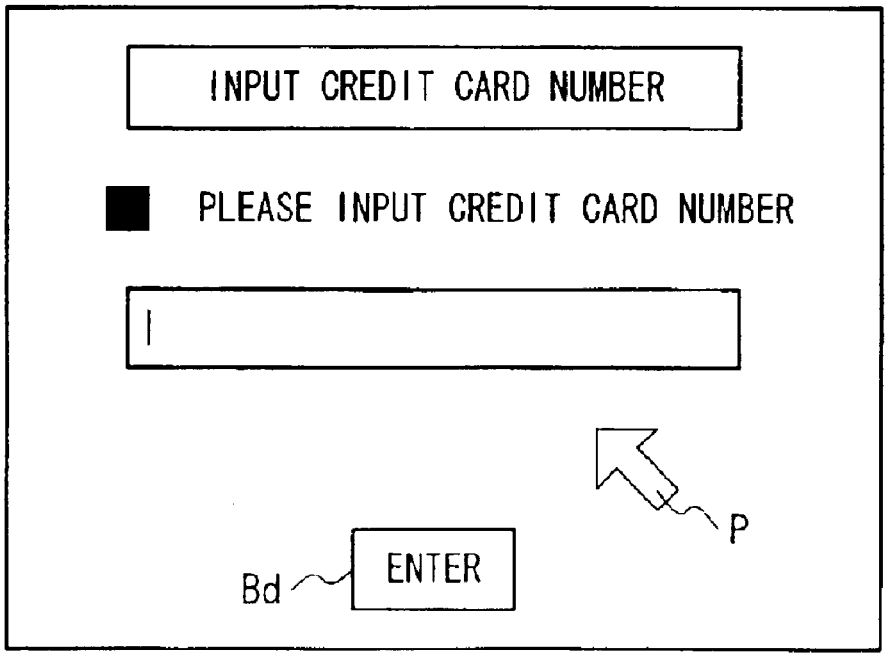
FIG. 12 shows an example of an image requesting the user to input a credit card number on the screen of the communication terminal.

After the user completes inputting real-play sound file creating conditions as described above, the flow proceeds to step Sa2 shown in FIG. 5 in which the CPU 301 executes service charge payment processing in the real-play sound provider 30. That is, the CPU 301 of the real-play sound provider 30 controls the communication terminal 10 online to display a dialog box requesting the user to input his/her credit card number on the screen of the display 103, an example of which is shown in FIG. 12. This dialog box contains an input region (or a text box) A1 allowing the user to input his/her credit card number for use in payment of charges for online services claimed by the real-play sound provider 30. Therefore, the user is requested to input his/her credit card number in the input region A1, and then, clicks an ENTER button Bd with a mouse. As a result, the CPU 301 of the real-play sound provider 30 recognizes the input credit card number, which is added to management files in the storage device 302.

Thereafter, the CPU 301 confirms whether or not the credit card number is properly input and is acceptable. That is, the CPU 301 of the real-play sound provider 30 transmits a request of certification (or authentication) including the input credit card number to the communication equipment (or computer facilities) of the corresponding credit card company or enterprise, which in turn makes determination as to whether or not the credit card number is properly assigned to a certain member registered therein, so that a determination result is transmitted to the real-play sound provider 30. Therefore, the CPU 301 of the real-play sound provider 30 can confirm whether or not the input credit card number is properly acceptable on the basis of the determination result.

Under the condition where the credit card number input by the user is acceptable for the real-play sound provider 30, the CPU 301 creates a user ID directly specifying the user, so that it controls the communication terminal 10 online to display a user ID notification on the screen of the display 103 in step Sa3. This user ID is used to confirm whether or not the user is authorized in using online services with the real-play sound provider 30 when the user operates the communication terminal 10 to request transmission of real-play sound files.

Figure 14:
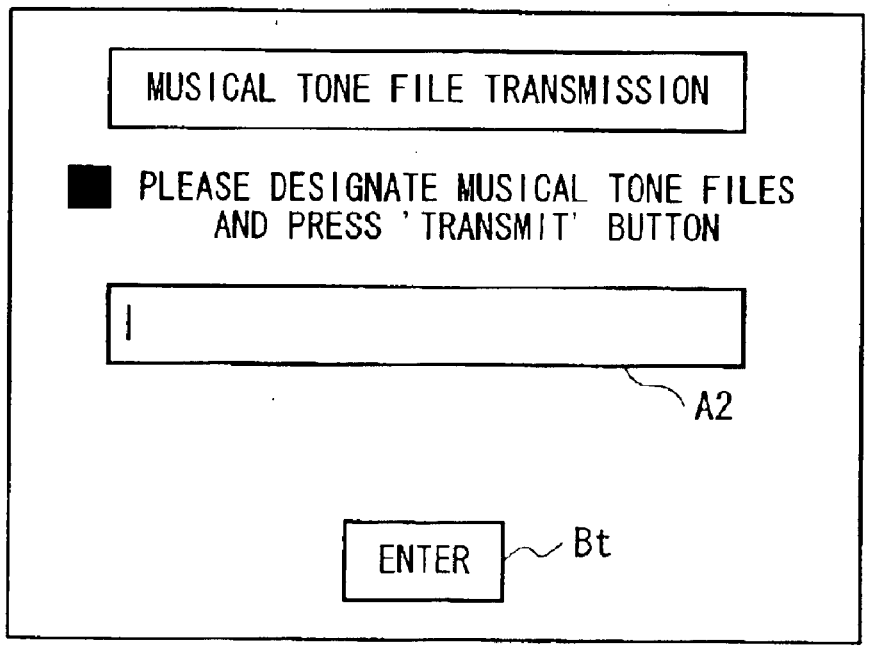
FIG. 14 shows an example of an image allowing the user to designate transmission of desired musical tone files on the screen of the communication terminal.

In step Sa4, the CPU 301 of the real-play sound provider 30 controls the communication terminal 10 to display a musical tone file transmission instruction on the screen of the display 103. That is, the display 103 displays a prescribed image shown in FIG. 14, which allows the user to request transmission of designated musical tone files therefor and which contains an input region A2 allowing the user to designate musical tone files for the real-play sound provider 30. Specifically, the user operates the keyboard (i.e., input device 104) of the communication terminal 10 to input an address (e.g., a folder name or a directory) locating musical tone files into the input region A2, and then, the user clicks a TRANSMIT button Bt with the mouse. As a result, the CPU 101 of the communication terminal 10 (see FIG. 2) reads from the storage device 102 designated musical tone files, which are then transmitted to the real-play sound provider 30 by way of the communication control device 107. Thus, the CPU 301 of the real-play sound provider 30 (see FIG. 3) stores musical tone files transmitted thereto from the communication terminal 10 in the storage device 302 in step Sa5.

(2) Second Operation for Creation of Real-Play Sound Files

After completion of the aforementioned first operation, the CPU 301 of the real-play sound provider 30 performs second operation to create real-play sound files based on musical tone files. The following description is made under a certain precondition where the user selects the automatic performance instrument 305 in the aforementioned preferred musical instrument selection menu of FIG. 7 and also selects a prescribed environment locating the automatic performance instrument 305 in the aforementioned play environment selection menu of FIG. 8. In this case, real-play sound files are created based on sounds of the automatic performance instrument 305.

First, the manager (or administrator) of the real-play sound provider 30 arranges the sound pickup device 306 relative to the automatic performance instrument 305 at a specific sound pickup position that is designated by the user of the communication terminal 10 on the aforementioned sound pickup position selection menu of FIG. 9. Then, the manager operates the input device 303 to select musical tone files that construct the basis for creation of real-play sound files, so that the CPU 301 performs prescribed corrections to musical tone files in response to characteristics of the utilized musical instrument that are selected by the user on the aforementioned utilized musical instrument selection menu of FIG. 11. Generally speaking, even when both a key of a synthesizer and a key of a piano are depressed with the same depressing force, the sound produced by the synthesizer is louder than the sound produced by the piano. Therefore, when the synthesizer is designated as the musical instrument used for creation of musical tone files, tone volumes (or velocities) of musical tones contained in musical tone files are corrected to be reduced by prescribed values. In other words, musical tone files are corrected to compensate for differences between characteristics of musical instruments used for creation of musical tone files.

Then, the CPU 301 sequentially outputs corrected musical tone files to the automatic performance instrument 305. Suppose that the automatic performance instrument 305 simulates a keyboard instrument in which strings are struck by hammers, wherein hammers are adequately driven at designated tone-generation timings to strike strings, so that corresponding musical tones are produced. Musical tones (i.e., real-play sounds) produced by the automatic performance instrument 305 are picked up by the sound pickup device 306, wherein they are transduced into analog signals, which are then converted to digital data by the A/D converter 307. Based on digital data output from the A/D converter 307, the CPU 301 creates real-play sound files in conformity with a prescribed file format that is selected by the user on the aforementioned output file format selection menu of FIG. 10, so that real-play sound files are stored in the storage device 302.

Figure 15:
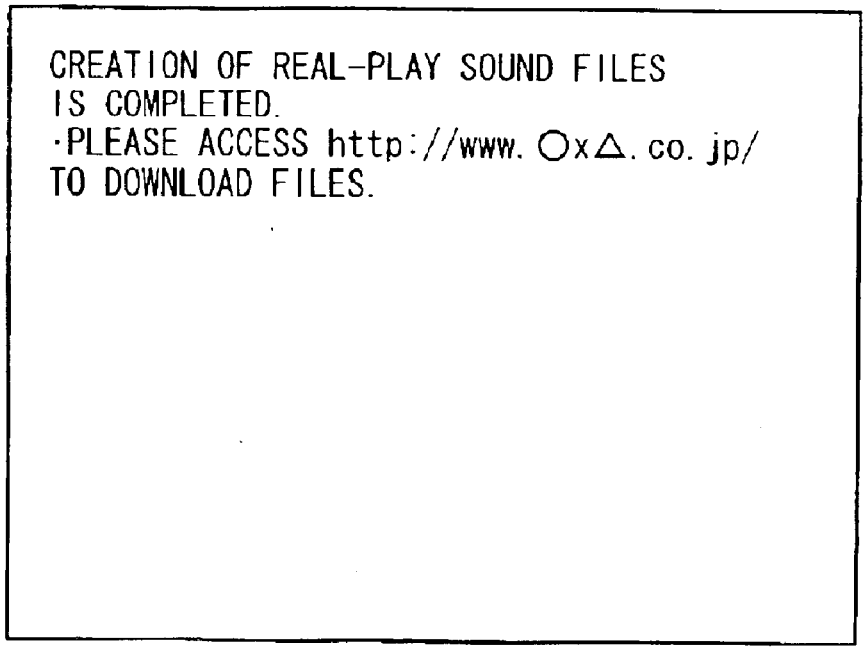
FIG. 15 shows an example of an image notifying the user of a URL by an electronic mail on the screen of the communication terminal.

After completion of creation of real-play sound files, the CPU 301 selects a URL (Uniform Resource Locator) locating a page that the user should access to read in order to obtain real-play sound files. In addition, the CPU 301 designates the communication terminal 10, which has transmitted musical tone files to the real-play sound provider 30, as a destination, to which the CPU 301 transmit an electronic mail (or e-mail) to notify the user of the selected URL. Upon reception of e-mail transmitted from the real-play sound provider 30, the user operates the communication terminal 10 so that the CPU 101 controls the display 103 to display the content of the e-mail on the screen. Specifically, the display 103 displays messages as shown in FIG. 15 on the screen, which include the URL specifying the location of real-play sound files and a statement authorizing the user to obtain real-play sound files by accessing a prescribed page designated by the URL.

The aforementioned description is made under the precondition where real-play sound files are created based on sounds produced by the automatic performance instrument 305. When the user designates the automatic performance instrument 402 within the file creation unit 40 that is not connected with the real-play sound provider 30, real-play sound files are created in following operations.

First, the real-play sound provider 30 receives musical tone files from the communication terminal 10 via the network 20, so that musical tone files are stored in the portable storage medium 320 by means of the read/write device 308. Then, the portable storage medium 320 is transported to a prescribed location where the file creation unit 40 is arranged. Therefore, the read/write device 401 of the file creation unit 40 reads musical tone files from the portable storage medium 320, so that musical tone files are sequentially supplied to the automatic performance instrument 402. Based on musical tone files, the automatic performance instrument 402 produces sounds, which are picked up by the sound pickup device 403 to produce analog signals, which are then converted to digital data by the A/D converter 404. Thus, digital data output from the A/D converter 404 are stored in the portable storage medium 320 as real-play sound files by means of the read/write device 401. Thereafter, real-play sound files stored in the portable storage medium 320 are transferred to the storage device 302 by means of the read/write device 308.

(3) Third Operation for Request and Transmission of Real-Play Sound Files

Figure 6:
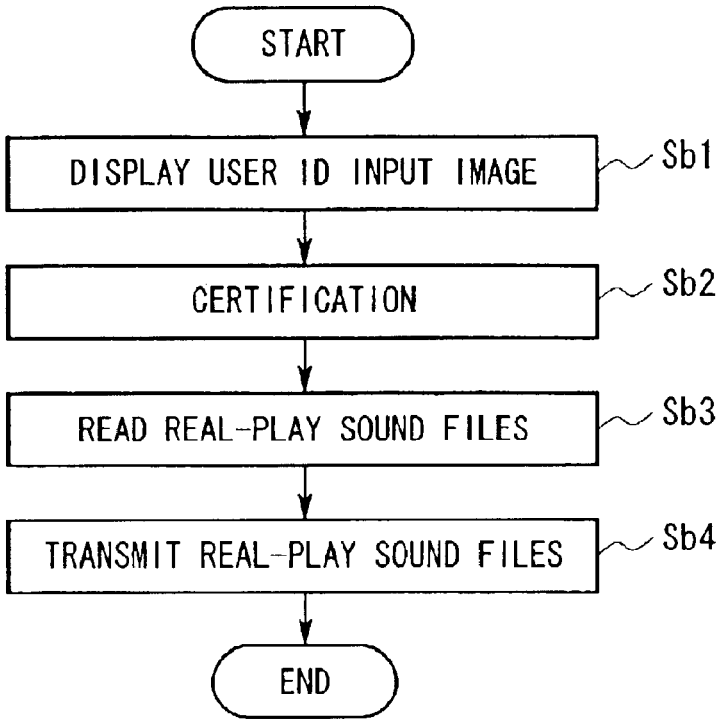
FIG. 6 is a flowchart showing a second process performed by the real-play sound provider realizing the processing shown in FIG. 4.

With reference to FIG. 6, a description will be given with respect to processing of the CPU 301 of the real-play sound provider 30 upon authorization when the communication terminal 10 obtains real-play sound files.

Figure 13:
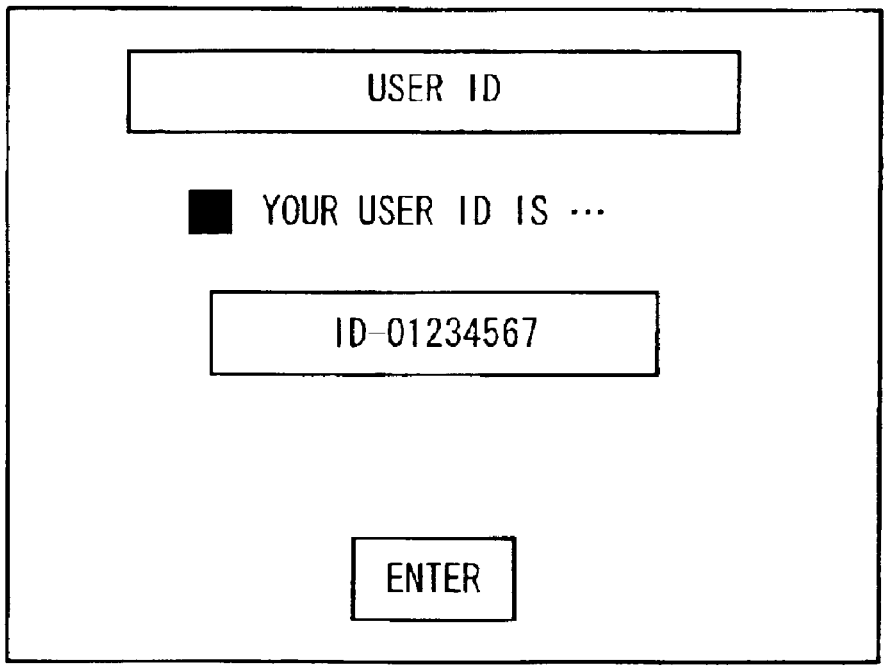
FIG. 13 shows an example of an image notifying the user of a user ID on the screen of the communication terminal.
Figure 16:
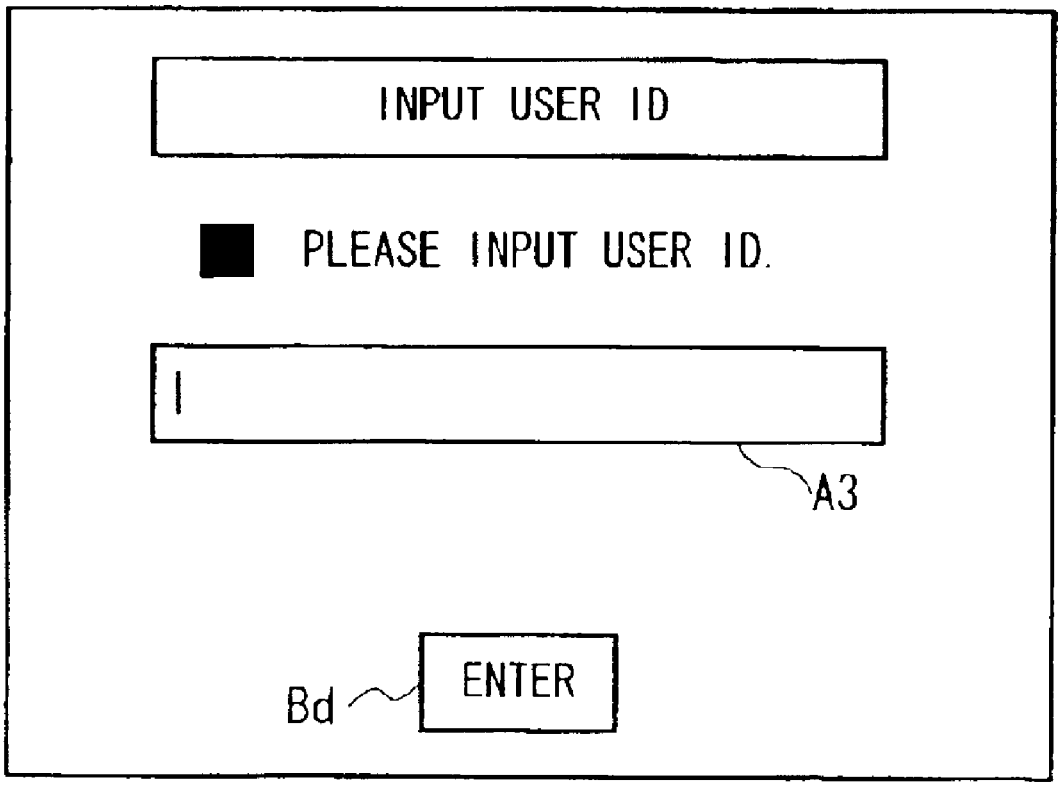
FIG. 16 shows an example of an image requesting the user to input his/her user ID on the screen of the communication terminal.

First, the user operates the communication terminal 10 to establish connection with the real-play sound provider 30 over the network 20. Then, the real-play sound provider 30 controls the communication terminal 10 online to display the aforementioned content of e-mail shown in FIG. 15 on the screen of the display 103. Upon confirmation of the e-mail, the user of the communication terminal 10 inputs the URL designated by the e-mail, so that the CPU 101 sends to the real-play sound provider 30 a signal requesting transmission of real-play sound files described on a prescribed page designated by the URL. Upon reception of this signal, the CPU 301 of the real-play sound provider 30 controls the communication terminal 10 online to display an image requesting the user to input his/her user ID on the screen of the display 103 in step Sb1, an example of which is shown in FIG. 16. This image contains an input region (or a dialog box) A3 allowing the user to input the user ID, which is notified to the user in the aforementioned image shown in FIG. 13 in the foregoing step Sa3 in FIG. 5. Then, the user inputs the user ID into the input region A3, and then clicks an ENTER button Bd with the mouse, so that the CPU 301 of the real-play sound provider 30 recognizes the user ID input by the user of the communication terminal 10. The flow proceeds to step Sb2 in which the CPU 301 makes certification as to whether or not the user ID is correctly input and is properly assigned to the user on the basis of contents of management files stored in the storage device 302. That is, the CPU 301 determines the user ID to be proper when the user ID matches any one of user IDs registered in management files. In contrast, the CPU 301 determines the user ID to be improper when the user ID does not match any one of user IDs registered in management files, so that the CPU 301 transmits to the communication terminal 10 a notification for refusing transmission of real-play sound files. When the user ID is determined to be proper, the flow proceeds to step Sb3 in which the CPU 301 reads real-play sound files, which are created for the user, from the storage device 302, so that real-play sound files are transmitted to the communication terminal 10 in step Sb4.

Upon reception of real-play sound files from the real-play sound provider 30 via the network 20, the CPU 101 of the communication terminal 10 stores these files in the storage device 102. Thereafter, the user operates the communication terminal 10 to read real-play sound files from the storage device 102, so that real-play sound files are sequentially supplied to the sound reproduction unit 108. As a result, it is possible to produce real-play sounds, which are produced by the automatic performance instrument 305 or the automatic performance instrument 402, in response to musical tone files, which the user creates by playing the MIDI instrument 105 and the like.

As described above, the present embodiment allows the user operating the communication terminal 10 to perform online and remote controls via the network 20, thus driving a prescribed musical instrument (e.g., the automatic performance instrument 305 or 402) based on musical tone files, which the user creates by himself/herself. In addition, the present embodiment realizes creation of real-play sound files representing sounds produced by the prescribed musical instrument, which are then transmitted to the communication terminal 10 via the network 20. Therefore, even though the user does not possess a preferred musical instrument, it is possible to the user to listen to musical tones produced by the preferred musical instrument in response to playing operations. In other words, the present embodiment allows the user to produce sounds of a preferred musical instrument, which the user desires to play virtually by himself/herself.

In addition, the present embodiment allows the user to arbitrarily set real-play sound file creation conditions such as musical instruments and play environments in creation of real-play sound files. Therefore, it is possible to create real-play sound files suiting user's preferences or wishes. Furthermore, the present embodiment allows the user to briefly listen to sounds of musical instruments, which the user would like to play virtually in creation of real-play sound files. Thus, the user can perform appropriate selection on musical instruments in consideration of the results of listenings (or auditions).

Moreover, a specific URL locating a page that the user is accessible to read real-play sound files is notified to the user by e-mail, so that real-play sound files are transmitted to the communication terminal 10 that is used to access the real-play sound provider 30 based on the URL. Therefore, when the communication terminal 10 is placed in a condition for receiving real-play sound files, the real-play sound provider 30 can transmit real-play sound files to the communication terminal 10 via the network 20. In other words, it is possible to avoid an undesirable situation where the communication terminal 10 is not placed to receive real-play sound files even when the real-play sound provider 30 proceeds to transmission of real-play sound files. Of course, the real-play sound provider 30 does not necessarily wait for a transmission request from the communication terminal in transmitting real-play sound files. That is, upon completion of creation of real-play sound files, the real-play sound provider 30 can instantaneously transmit them to the communication terminal 10.

[C] Modifications

This invention is described heretofore by way of the aforementioned embodiment, which is illustrative and is not restrictive; hence, it is possible to provide a variety of modifications without departing from the scope of the invention.

Examples of modifications will be described below.

(1) First Modification

The present embodiment described above is designed to create real-play sound files by using a prescribed musical instrument having automatic performance functions (e.g., the automatic performance instrument 305 or 402). Of course, musical instruments for use in creation of real-play sound files are not necessarily limited to prescribed incorporating automatic performance functions. For example, it is possible to use a keyboard instrument, which does not have automatic performance functions, in creation of real-play sound files. In this case, an automatic performance apparatus can be installed in the keyboard instrument, thus realizing automatic performance. Specifically, the automatic performance apparatus comprises depression members, which can control keys to be automatically depressed, and a depression drive structure for driving depression members respectively in response to musical tone files. That is, by adapting this automatic performance apparatus, it is possible to create real-play sound files by use of an acoustic instrument that does not have automatic performance functions. For example, it is possible to create real-play sound files by use of musical instruments having antique value, musical instruments having historical value or academic value, and the like (e.g., pipe organs installed in churches). In summary, this invention requires musical instruments having sound sources to realize automatic performance functions based on musical tone files without playing them manually.

In addition, the present embodiment uses a keyboard instrument, in which strings are struck in response to keys being depressed, as an example of a musical instrument (e.g., the automatic performance instrument 305 or 402) used for creation of real-play sound files. Of course, the application of this invention is not necessarily limited to such a string-striking type keyboard instrument. For example, this invention can be applied to bar-type percussion instruments such as a xylophone and a glockenspiel as well as other types of musical instruments that produce sounds without striking strings or bars, for example. In summary, this invention can be applied to any type of musical instruments having tone-generation mechanisms that realize automatic performances based on musical tone files.

Furthermore, it is possible to isolate the unit comprising the automatic performance instrument 305, sound pickup device 306, and A/D converter 307 from the real-play sound provider 30, so that this unit is connected with the real-play sound provider 30 through communication over the network 20, for example. That is, the automatic performance instrument 305 plays automatic performance based on musical tone files that are transmitted thereto from the real-play sound provider 30 via the network 20, wherein sounds produced by the automatic performance instrument 305 are picked up by the sound pickup device 30 to produce analog signals, which are then converted to digital data by the A/D converter 307, so that digital data are transmitted to the real-play sound provider 30. In summary, it does not matter how real-play sound files are created in this invention, and this invention requires real-play sound files, representing sounds produced by a prescribed musical instrument playing automatic performance based on musical tone files, to be stored in the storage device 302 of the real-play sound provider 30.

(2) Second Modification

The present embodiment deals with musical tone files according to the SMF format. Of course, the format adapted to musical tone files is not necessarily limited to the SMF format. That is, this invention requires that musical tone files include specific data controlling a prescribed musical instrument to play automatic performance. Specifically, it is satisfactory that musical tone files include at least tone pitches and tone-generation timings of musical tones.

The present embodiment allows the user to arbitrarily select any one of prescribed formats for use in real-play sound files as shown in FIG. 10. Of course, the file format adapted to real-play sound files is not necessarily limited to these formats. That is, it is required that real-play sound files represent sounds produced by the sound reproduction unit of the communication terminal.

(3) Third Modification

In the present embodiment, the communication terminal 10 transmits musical tone files and receive real-play sound files instead. Of course, it is unnecessary for the same communication terminal to transmit musical tone files and to receive real-play sound files. For example, one communication terminal transmits musical tone files to the real-play sound provider, while the other communication terminal accesses the real-play sound provider in response to the URL notified by e-mail so as to receive real-play sound files therefrom.

In addition, the communication terminal transmitting musical tone files and/or the communication terminal receiving real-play sound files is not necessarily connected to the network 20 through wired communications. That is, it is possible to use so-called portable communication terminals that can perform wireless communications over prescribed channels with a base station contained in the network 20.

(4) Fourth Modification

In the present embodiment, real-play sound files representing sounds produced by a prescribed musical instrument are only transmitted to the communication terminal 10. Of course, it is possible to transmit real-play sound files together with image files representing moving pictures and/or still pictures to the communication terminal 10. That is, images of the prescribed musical instrument playing automatic performance are picked up by an image pickup device such as a digital camera to produce image files, which are attached to real-play sound files and are transmitted to the communication terminal 10. Therefore, the communication terminal 10 controls the display 103 to display images corresponding to image files on the screen. Thus, the user of the communication terminal 10 can visually confirm the situation in which real-play sound files are created by the prescribed musical instrument.

(5) Fifth Modification

In the present embodiment, real-play sound files are created using a prescribed musical instrument that is arranged in a prescribed environment, which is selected by the user in the aforementioned play environment selection menu of FIG. 8. That is, the present embodiment allows the user to arbitrarily select any one of different environments for locating the prescribed musical instrument. Herein, it is possible to impart specific sound effects to digital data representing real-play sounds in response to the user's selection on the play environment selection menu. For example, sample data of impulse response waveforms are prepared in advance in response to prescribed play environments (e.g., concert halls and churches), which can be listed in the play environment selection menu of FIG. 8 for the user's selection. In this case, sample data corresponding to a prescribed play environment selected by the user are convoluted into digital data output from the A/D converter 307 or 404, for example. Thus, it is possible to reflect initial reflection sounds and reverberation effects in desired places or spaces whose acoustics suit user's preferences on sounds represented by real-play sound files without requiring musical instruments to be actually arranged in desired places or spaces in creation of real-play sound files.

(6) Sixth Modification

This invention is not necessarily realized by the hardware but can be realized by software. That is, the aforementioned controls can be realized by programs executed by computers having abilities of communicating with communication terminals via networks, for example. Herein, programs describe three functions as follows:

(i) First function to receive musical tone files, which include at least tone pitches and tone-generation timings of musical tones, from a prescribed communication terminal.

(ii) Second function to store real-play sound files representing sounds, which are produced from a prescribed musical instrument playing automatic performance based on musical tone files, in a prescribed storage device.

(iii) Third function to transmit real-play sound files stored in the storage device to the communication terminal.

Therefore, this invention can be embodied by computer-readable storage media recording the aforementioned programs. As computer-readable storage media, it is possible to use portable storage media such as floppy disks and CD-ROMs as well as magnetic disks and semiconductor memories, for example.

As described heretofore, this invention has a variety of effects and technical features, which will be described below.

(1) This invention is realized by at least one communication terminal, a real-play sound provider, and a network. Herein, the real-play sound provider receives musical tone files, which include tone pitches and tone-generation timings for designated musical tones, from the communication terminal via the network, so that it creates real-play sound files representing sounds produced from a prescribed musical instrument playing automatic performance based on musical tone files. Real-play sound files are stored in a storage device and are transmitted to the communication terminal via the network.

(2) Therefore, the user of the communication terminal can listen to real-play sounds of the prescribed musical instrument, which is not actually possessed or played by the user. In addition, the user can arbitrarily create musical tone files that construct the basis for automatic performance, so that the user can obtain real-play sounds of a preferred musical instrument in response to user's playing operations.

(3) The communication terminal has an ability to transmit musical tone files to the real-play sound provider via the network and an ability to receive real-play sound files from the real-play sound provider via the network. In addition, the communication terminal controls a sound reproduction unit to produce musical tones in response to real-play sound files.

(4) The aforementioned operations can be realized by programs, which are executed by a computer connected with the communication terminal via the network and which describe three functions, namely, a first function to receive musical tone files from the communication terminal, a second function to create real-play sound files based on musical tone files and to store them in a storage device, and a third function to transmit real-play sound files to the communication terminal. The aforementioned programs can be stored in any type of digital storage media.

(5) In addition, communications of data and files are performed in user-friendly and interactive manner between the communication terminal and the real-play sound provider, wherein the user can arbitrarily set real-play sound file creation conditions such as musical instruments, play environments, and file formats; and then, upon certification of a user ID assigned to the user, real-play sound files are downloaded to the communication terminal.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A real-play sound provider comprising:

a receiver for receiving musical tone files, which include tone pitches and tone-generation timings of designated musical tones, from a communication terminal via a network;

a controller for controlling a prescribed musical instrument to play automatic performance based on the musical tone files and for storing real-play sound files representing sounds produced by the prescribed musical instrument in a storage device; and a transmitter for transmitting real-play sound files stored in the storage device to the communication terminal via the network.

2. A real-play sound provider according to claim 1, wherein the receiver receives user's designation regarding the prescribed musical instrument from the communication terminal, so that upon reception of the user's designation, the controller controls the prescribed musical instrument to play automatic performance.

3. A real-play sound provider according to claim 1, wherein the receiver receives user's designation regarding a play environment in which the prescribed musical instrument plays automatic performance from the communication terminal, and the controller modifies the real-play sound files in accordance with the user's designated play environment.

4. A real-play sound provider according to claim 1, wherein the receiver receives user's designation regarding a file format for creation of the real-play sound files, so that the controller proceeds to create the real-play sound files suiting the designated file format and to store them in the storage device.

5. A real-play sound provider according to claim 1, wherein the receiver receives user's designation regarding a user-side musical instrument, which is used to create the musical tone files, from the communication terminal, so that the controller controls the prescribed musical instrument to play automatic performance based on the musical tone files, which are corrected in response to characteristics of the user-side musical instrument upon reception of the user's designation, so as to store the real-play sound files corresponding to the corrected musical tone files in the storage device.

6. A real-play sound provider according to claim 1, wherein the musical tone files are created in conformity with a MIDI standard.

7. A real-play sound provider according to claim 1, wherein the controller notifies the communication terminal of an address, which allows the user of the communication terminal to access a prescribed page to read the real-play sound files stored in the storage device, so that the transmitter proceeds to transmission of the real-play sound files when accessed by the communication terminal.

8. A real-play sound provider according to claim 1, wherein upon reception of a transmission request from the communication terminal, the transmitter transmits sample data representing sound of the prescribed musical instrument to the communication terminal.

9. A communication terminal comprising:

a transmitter for transmitting musical tone files, which include tone pitches and tone-generation timings of designated musical tones, to a real-play sound provider via a network;

a receiver for receiving real-play sound files representing sounds of a prescribed musical instrument playing automatic performance based on the musical tone files from the real-play sound provider; and a controller for controlling a sound reproduction unit to produce sounds in response to the real-play sound files.

10. A communication terminal according to claim 9, wherein the controller allows the user to arbitrarily set real-play sound file creation conditions on a screen of a display.

11. A communication terminal according to claim 10, wherein a list of musical instruments is displayed for user's selection on the screen of the display, so that the selected musical instrument is notified to the real-play sound provider in order to create the real-play sound files.

12. A communication terminal according to claim 10, wherein play environments are displayed for user's selection on the screen of the display, so that the selected play environment is notified to the real-play sound provider in order to create the real-play sound files.

13. A communication terminal according to claim 10, wherein file formats are displayed for user's selection on the screen of the display, so that the real-play sound provider stores the real-play sound files suiting the selected file format in a storage device.

14. A communication terminal according to claim 10, wherein an address for accessing a prescribed page describing the real-play sound files stored in a storage device of the real-play sound provider is notified from the real-play sound provider and is displayed on the screen of the display.

15. A communication terminal according to claim 11, wherein the controller allows the user to briefly listen to sound of the selected musical instrument on the basis of sample data representing the sound of the selected musical instrument, which is transmitted from the real-play sound provider.

16. A real-play sound providing method implemented in a computer having an ability to communicate with a communication terminal over a network, comprising the steps of:

receiving musical tone files, which include tone pitches and tone-generation timings of designated musical tones, from the communication terminal via the network;

proceeding to creation of real-play sound files representing sounds produced by a prescribed musical instrument playing automatic performance in response to the musical tone files;

storing the real-play sound files in a storage device; and transmitting the real-play sound files stored in the storage device to the communication terminal.

17. A computer-readable storage media storing programs that cause a computer having an ability to communicate with a communication terminal over a network to perform a real-play sound providing method comprising the steps of:

receiving musical tone files, which include tone pitches and tone-generation timings of designated musical tones, from the communication terminal via the network;

proceeding to creation of real-play sound files representing sounds produced by a prescribed musical instrument playing automatic performance in response to the musical tone files;

storing the real-play sound files in a storage device; and transmitting the real-play sound files stored in the storage device to the communication terminal.

18. A real-play sound providing method according to claim 16 further comprising the step of:

allowing a user of the communication terminal to arbitrarily select the prescribed musical instrument from among a plurality of musical instruments.

19. A real-play sound providing method according to claim 16 further comprising the step of:

allowing a user of the communication terminal to arbitrarily select any one of play environments, so that the real-play sound files are created in accordance with the selected play environment.

20. A real-play sound providing method according to claim 16 further comprising the step of:

allowing a user of the communication terminal to arbitrarily select any one of file formats, so that the real-play sound files are created and stored in the storage device in conformity with the selected file format.

21. A real-play sound providing method according to claim 16 further comprising the step of:

notifying a user of the communication terminal of an address for accessing a prescribed page describing the real-play sound files stored in the storage device of the real-play sound provider.

22. A real-play sound providing method according to claim 18 further comprising the step of:

allowing a user of the communication terminal to briefly listen to sound of the selected musical instrument on the basis of sample data representing the sound of the selected musical instrument.

* * * * *